US010281861B2

(12) United States Patent
Tanaka

(10) Patent No.: US 10,281,861 B2
(45) Date of Patent: May 7, 2019

(54) IMAGE FORMING APPARATUS USING TEST IMAGES TO ADJUST POSITION OF LATENT IMAGE

(71) Applicant: CANON KABUSHIKI KAISHA, Tokyo (JP)

(72) Inventor: Sumito Tanaka, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/360,732

(22) Filed: Nov. 23, 2016

(65) Prior Publication Data

US 2017/0153588 A1 Jun. 1, 2017

(30) Foreign Application Priority Data

Nov. 30, 2015 (JP) ..... 2015-234284

(51) Int. Cl.
*G03G 15/04* (2006.01)
*G03G 15/00* (2006.01)
*G03G 15/043* (2006.01)

(52) U.S. Cl.
CPC ..... *G03G 15/5062* (2013.01); *G03G 15/043* (2013.01); *G03G 15/55* (2013.01)

(58) Field of Classification Search
None
See application file for complete search history.

(56) References Cited

U.S. PATENT DOCUMENTS

2001/0004425 A1* 6/2001 Shinohara ..... H04N 1/4078 399/301
2005/0041988 A1* 2/2005 Kaneko ..... G03G 15/5095 399/45
2012/0092687 A1 4/2012 Hirai
2013/0156445 A1 6/2013 Takemura
2014/0255046 A1* 9/2014 Takemura ..... G03G 15/5062 399/15
2017/0153586 A1* 6/2017 Tanaka ..... G03G 15/50

FOREIGN PATENT DOCUMENTS

JP 2011-133771 A 7/2011

* cited by examiner

*Primary Examiner* — Thomas S Giampaolo, II
(74) *Attorney, Agent, or Firm* — Canon U.S.A., Inc. IP Division

(57) ABSTRACT

The image forming apparatus includes an adjustment unit that adjusts the position where the electrostatic latent image is formed in a rotation axis direction of a photoconductor in accordance with the position of a sheet that has reached the transfer unit in the rotation axis direction of the photoconductor. The adjustment unit adjusts the position where the electrostatic latent image is formed in the rotation axis direction of the photoconductor in normal printing and does not adjust the position where the electrostatic latent image is formed in the rotation axis direction of the photoconductor in a case where a test image is to be printed.

7 Claims, 10 Drawing Sheets

| ADDRESS i | -6 | -5 | -4 | -3 | -2 | -1 | 0 | +1 | +2 | +3 | +4 | +5 | +6 |
|---|---|---|---|---|---|---|---|---|---|---|---|---|---|
| DENSITY Di | 0.21 | 0.22 | 0.24 | 0.26 | 0.27 | 0.27 | 0.28 | 0.3 | 0.32 | 0.31 | 0.29 | 0.28 | 0.26 |
| CORRECTION VALUE Pi | 6 | 5 | 3 | 1 | -0 | 0 | -1 | -3 | -5 | -4 | -2 | -1 | 1 |

| ADDRESS i | -6 | -5 | -4 | -3 | -2 | -1 | 0 | +1 | +2 | +3 | +4 | +5 | +6 |
|---|---|---|---|---|---|---|---|---|---|---|---|---|---|
| DENSITY Di | - | 0.22 | 0.24 | 0.26 | 0.27 | 0.27 | 0.28 | 0.3 | 0.32 | 0.31 | 0.29 | 0.28 | - |
| CORRECTION VALUE Pi | 5 | 5 | 3 | 1 | -0 | 0 | -1 | -3 | -5 | -4 | -2 | -1 | -1 |

FIG. 10

| Position in main scanning direction | Y | M | C | Bk |
|---|---|---|---|---|
| +6 | 1 | 0 | 1 | 1 |
| +5 | −1 | −1 | −1 | −1 |
| +4 | −2 | −2 | −2 | −2 |
| +3 | −4 | −4 | −3 | −1 |
| +2 | −5 | −4 | −2 | −3 |
| +1 | −3 | −3 | −3 | −2 |
| 0 | −1 | −2 | −1 | −1 |
| −1 | 0 | 0 | 0 | 0 |
| −2 | 0 | 1 | 0 | 0 |
| −3 | 1 | 1 | 1 | 1 |
| −4 | 3 | 2 | 2 | 2 |
| −5 | 5 | 3 | 1 | 3 |
| −6 | 6 | 4 | 2 | 2 |

Completion

IMAGE FORMING APPARATUS USING TEST IMAGES TO ADJUST POSITION OF LATENT IMAGE

BACKGROUND OF THE INVENTION

Field of the Invention

The present disclosure relates to an electrophotographic image forming apparatus, such as a multifunction apparatus or a copying machine, which includes a reading unit.

Description of the Related Art

In a typical electrophotographic image forming apparatus, after a rotating photoconductor is uniformly charged with a charger, the photoconductor is exposed to light in accordance with image data to form an electrostatic latent image. The image forming apparatus develops the electrostatic latent image with toner and transfers the developed toner on a sheet for fixing. A configuration is used in which a desired image is printed through such an image forming process.

In the electrophotographic method, density unevenness may occur in a toner image formed on a sheet in a rotation axis direction of the photoconductor. This unevenness is caused by variation in the intensity of light used to form an electrostatic latent image on the photoconductor or variation in the sensitivity of the photoconductor to light.

In order to suppress the density unevenness in the rotation axis direction of the photoconductor, Japanese Patent Laid-Open No. 2011-133771 proposes the following configuration. Specifically, in the configuration proposed in Japanese Patent Laid-Open No. 2011-133771, multiple test patterns are printed on a sheet in the rotation axis direction of the photoconductor. The sheet on which the test patters are printed is fed again and the multiple test patterns are read with a density sensor provided on a sheet conveyance path. The laser intensity is adjusted at each position in a main scanning direction on the basis of the density that is read.

The sheet that has reached a transfer unit may be shifted from a desired position in the rotation axis direction of the photoconductor. In other words, desired positional relationship may not be established between the position of the sheet that has reached the transfer unit and the position of the toner image in the rotation axis direction of the photoconductor. The image forming apparatus generally corrects the positional relationship between the sheet and the toner image by adjusting the position of the electrostatic latent image to be formed on the photoconductor. However, in a case where the test images for correcting the density unevenness are printed, as in the disclosure described in Japanese Patent Laid-Open No. 2011-133771, the adjustment of the position where the electrostatic latent image is formed may reduce the correction accuracy of the density unevenness. This is because the adjustment of the position where the electrostatic latent image is formed shifts the position of the toner image in the rotation axis direction of the photoconductor from the position on the photoconductor to be corrected to.

SUMMARY OF THE INVENTION

An image forming apparatus includes a rotating photoconductor, an exposure unit, a developing unit, a transfer unit, an adjustment unit, a reading unit, a data generating unit, and a correction unit. The exposure unit exposes the photoconductor to light to form an electrostatic latent image on the photoconductor. The developing unit develops the electrostatic latent image formed on the photoconductor with toner. The transfer unit transfers a toner image developed on the photoconductor by the developing unit on a sheet. The adjustment unit is capable of adjusting a position where the electrostatic latent image is formed in a rotation axis direction of the photoconductor by controlling the exposure unit in order to adjust a position of the toner image in the rotation axis direction of the photoconductor on a sheet that has reached the transfer unit. The reading unit reads a test image. The data generating unit generates correction data used to correct densities of images in a plurality of areas on the photoconductor, which correspond to an area where the toner image is formed in the test image in the rotation axis direction of the photoconductor, based on a result of reading of the test image formed on a sheet by the reading unit. The correction unit corrects a density of the toner image to be developed on the photoconductor in the rotation axis direction of the photoconductor using the correction data generated by the data generating unit. The adjustment unit adjusts the position where the electrostatic latent image is formed in the rotation axis direction of the photoconductor in a case where an image other than the test image is to be formed on a sheet and does not adjust the position where the electrostatic latent image is formed in the rotation axis direction of the photoconductor in a case where the test image is to be formed on a sheet.

Further features of the disclosure will become apparent from the following description of exemplary embodiments with reference to the attached drawings.

BRIEF DESCRIPTION OF THE DRAWINGS

FIG. 10 illustrates a manual input screen of correction values.

DESCRIPTION OF THE EMBODIMENTS

[Schematic Configuration of Entire Image Forming Apparatus]

The present disclosure is provided to improve the accuracy of correction of the density unevenness using test images in an image forming apparatus that is capable of adjusting the position of an electrostatic latent image.

Figure 1A:
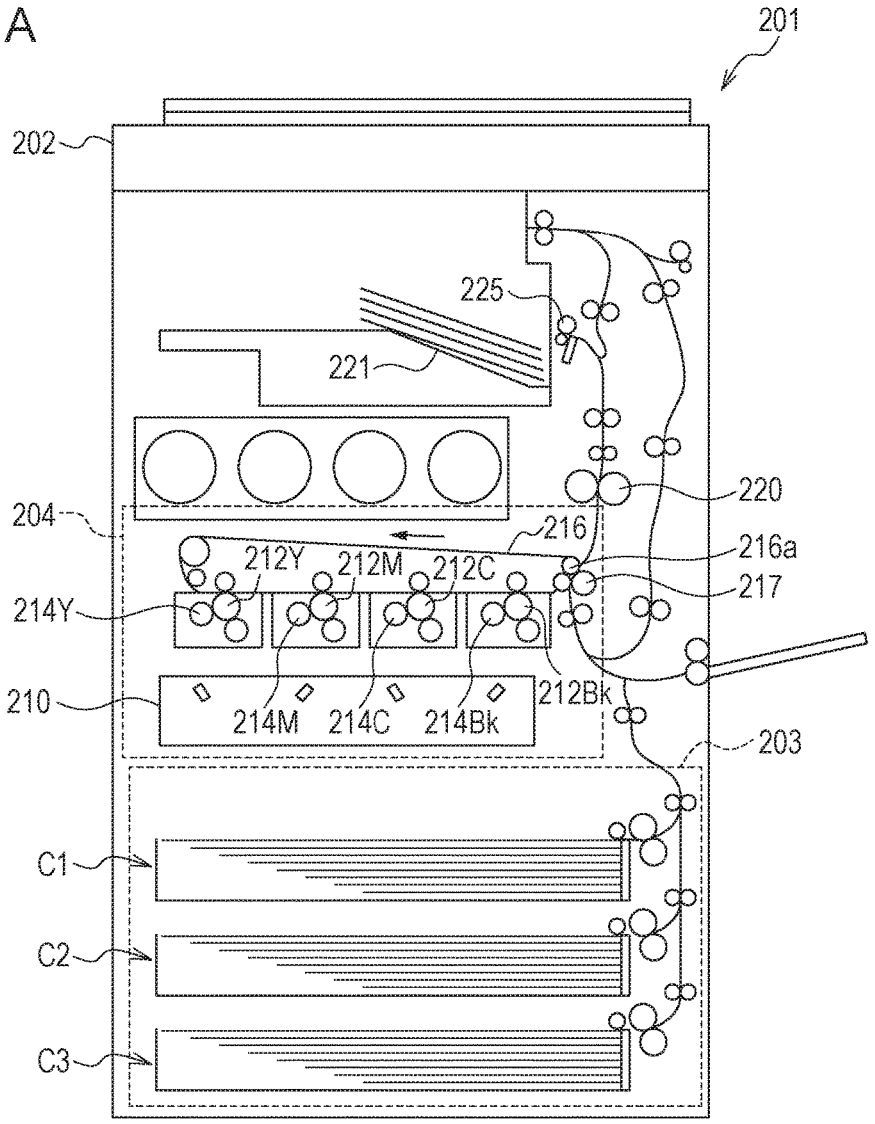
FIG. 1A is a schematic cross-sectional view of the entire image forming apparatus according to an embodiment and FIG. 1B is a control block diagram of the image forming apparatus.
Figure 1B:
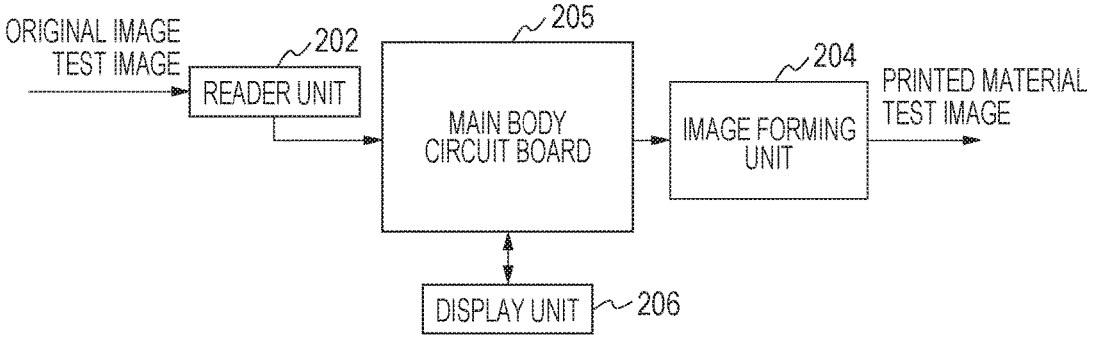

FIG. 1A is a schematic cross-sectional view of a copying machine 201, which is an image forming apparatus according to an embodiment, and FIG. 1B is a control block diagram of the copying machine 201. The copying machine 201 mainly includes a reader unit 202, which is a reader of an original image, an image forming unit 204 that forms a toner image and transfers the toner image on a sheet, and a sheet feeding unit 203 that feeds and conveys a sheet to the image forming unit. The image forming unit 204 includes photoconductive drums 212Y, 212M, 212C, and 212Bk, which are photoconductors corresponding to yellow (Y), magenta (M), cyan (C), and black (Bk), and developing units 214Y, 214M, 214C, and 214Bk. Since the configuration for forming a toner image is common to the respective colors, notation of Y, M, C, and Bk representing the respective colors is hereinafter omitted. An exposure unit 210 that exposes the photoconductive drum 212 to light on the basis of image data is provided below the photoconductive drum 212. The exposure unit 210 exposes the photoconductive drum 212 to light in accordance with image data supplied from a main body circuit board 205 with a configuration described below to form an electrostatic latent image. The electrostatic latent image formed on the photoconductive drum 212 is developed with the developing unit 214 and a toner image is formed on the photoconductive drum 212. The toner image is temporarily borne on an image bearing belt 216 and, then, is secondary-transferred to a sheet in a transfer unit composed of a transfer roller 216*a* and a transfer roller 217. A sensor (density detection sensor) 77 (refer to FIG. 3) that detects the density of the toner image borne on the image bearing belt 216 is provided near the transfer unit.

The sheet feeding unit 203 supplies a sheet housed in any of paper cassettes C1 to C3 to the transfer unit. The paper cassettes C1 to C3 are configured so as to be capable of housing sheets of various sizes (for example, A4 size, letter (LTR) size, A3 size, and B4 size). The sheet on which the toner image is transferred in the transfer unit is supplied to a fixing unit 220. The sheet on which the toner image is fixed in the fixing unit 220 is discharged to a discharge tray 221 via a discharge roller 225.

[Configuration of Reader Unit]

The reader unit 202 mounted in an upper portion of the copying machine includes a white light emitting diode (LED) and a complementary metal oxide semiconductor (CMOS) sensor including a RGB filter. Upon start of a reading operation by the reader unit, the white LED irradiates an original document with light and reflected light from the original document is detected by the CMOS sensor. The CMOS sensor acquires information about the density of each color on the basis of the reflected light from the original document. The information about the density of each color is transferred to a controller 205*a* (refer to FIG. 3) provided in the main body circuit board 205. The controller 205*a* converts the information about the density of each color into image data for printing. The image data for printing is supplied to the exposure unit 210 described below.

[Configuration of Exposure Unit]

The exposure unit 210 exposes the photoconductive drum 212 to light on the basis of the image data supplied from the main body circuit board 205. In the present embodiment, the exposure unit 210 is exemplified by an optical scanning apparatus, or an optical scanner, that uses a semiconductor laser as a light source.

Figure 2A:
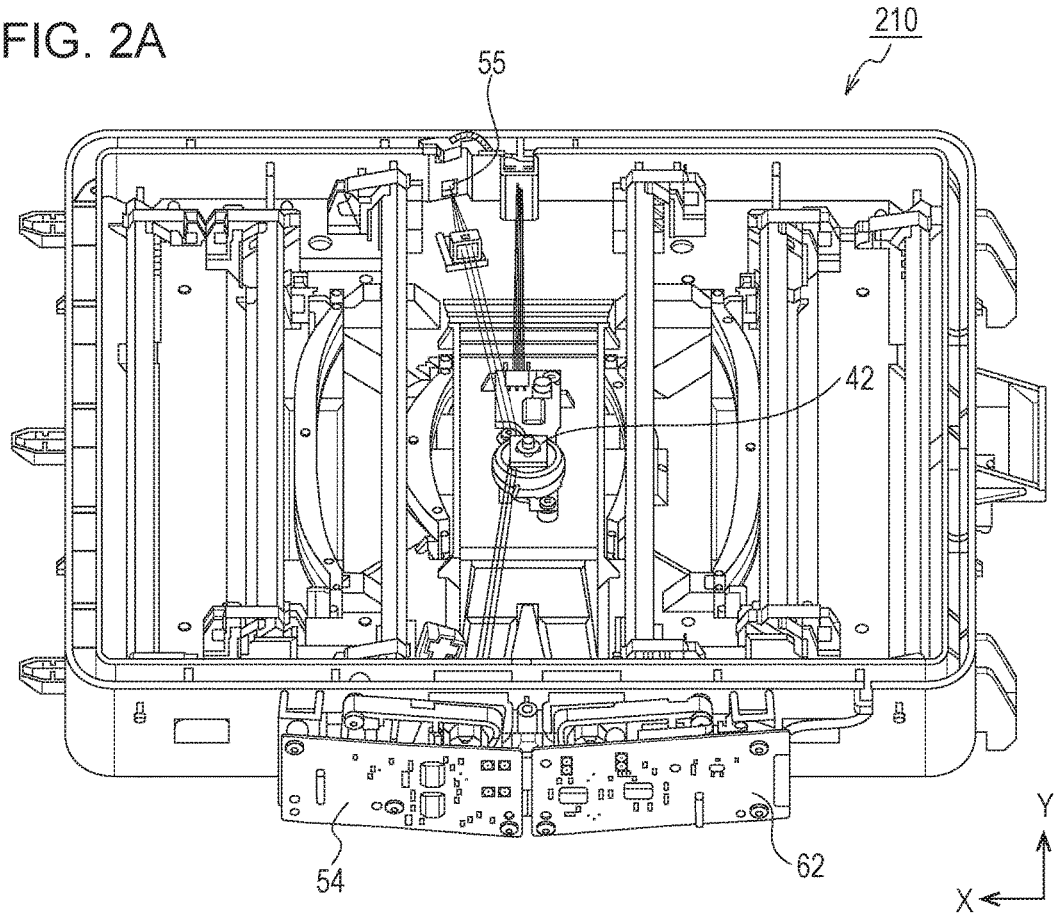
FIG. 2A is a perspective view of an optical scanning apparatus, which is an exposure unit.
Figure 2B:
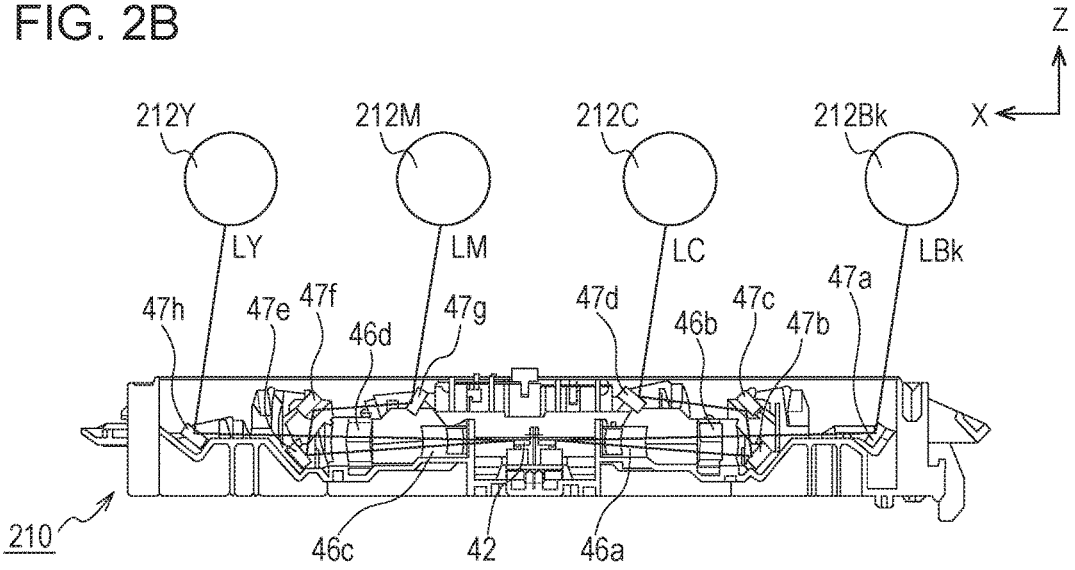
FIG. 2B is a cross-sectional view illustrating the positional relationship between the optical scanning apparatus and a photoconductive drum.
Figure 3:
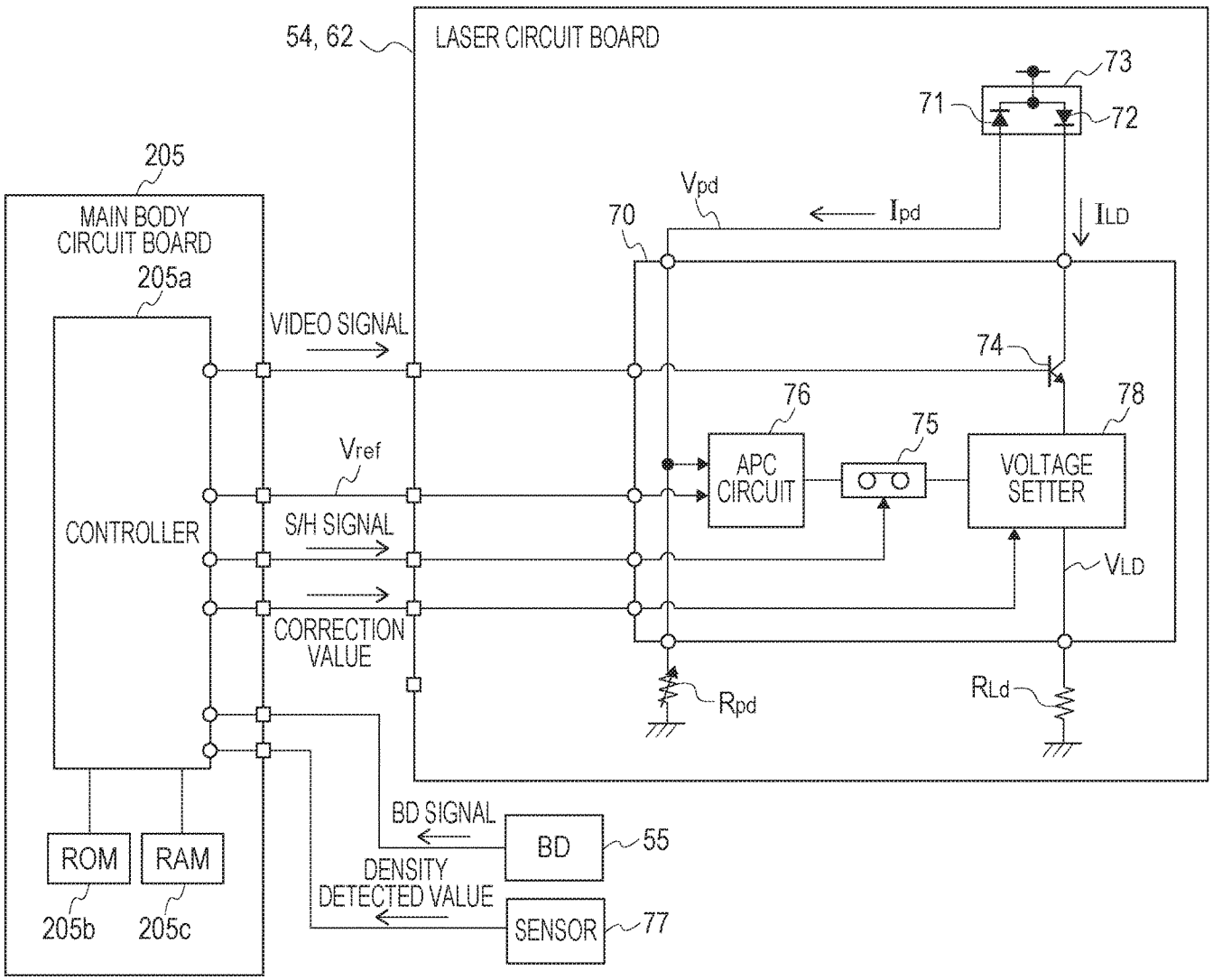
FIG. 3 illustrates the relationship in control between a main body circuit board, a laser circuit board, a BD, and a sensor.

FIG. 2A is a perspective view illustrating the entire image of the optical scanning apparatus 210, which is the exposure unit. FIG. 2B is a cross-sectional view illustrating the positional relationship between the optical scanning apparatus 210 and the photoconductive drum 212. FIG. 3 illustrates the relationship in control between the main body circuit board 205 and a laser circuit board 54 or a laser circuit board 62 provided in the optical scanning apparatus 210. The laser circuit board 54 corresponds to yellow and magenta and the circuit corresponding to magenta is the same as the circuit corresponding to yellow. Accordingly, only the circuit corresponding to yellow is illustrated in FIG. 3 and the circuit corresponding to magenta is not illustrated in FIG. 3. Similarly, the laser circuit board 62 corresponding to cyan and black is not illustrated in FIG. 3.

As illustrated in FIG. 2A, the laser circuit boards 54 and 62 are mounted to the optical scanning apparatus 210. The laser circuit boards 54 and 62 each include a semiconductor laser 73 illustrated in FIG. 3. The semiconductor laser 73 includes a light emitting unit (laser diode (LD)) 72. The LD 72 emits laser light in accordance with the image data supplied from the main body circuit board 205.

Referring to FIG. 2B, a rotating polygon mirror 42, which is a deflector, fθ lenses 46*a* to 46*d*, and refection mirrors 47*a* to 47*h* are provided in the optical scanning apparatus 210. A light beam LBk emitted from the LD 72 is deflected by the rotating polygon mirror 42 and is incident on a beam detector (BD) 55 and the fθ lens 46*d*. The function of the BD 55 will be described below. The light beam LBk that has passed through the fθ lens 46*d* is reflected by the refection mirror 47*h*. The light beam LBk reflected from the refection mirror 47*h* scans the photoconductive drum 212Bk. Similarly, light beams LY, LM, and LC are led to the photoconductive drums 212 of the corresponding colors. The direction of scanning on the photoconductive drum (substantially equal to the rotation axis direction of the photoconductive drum) is hereinafter referred to as a main scanning direction.

A driving configuration for driving the semiconductor laser will now be described with reference to FIG. 3. A laser driver 70, the semiconductor laser 73, a resistor Rpd, and a resistor RLd are mounted on the laser circuit board.

The controller 205*a*, a read only memory (ROM) 205*b*, and a random access memory (RAM) 205*c* are mounted in the main body circuit board 205. The controller 205*a* receives a BD signal from the BD 55. The copying machine 201, which is the image forming apparatus of the present embodiment, includes the sensor (optical sensor) 77 that detects a density detection toner pattern of each color, which is formed on the image bearing belt 216 by the image forming unit 204. The controller 205*a* receives a signal indicating a density detection value from the sensor (optical sensor) 77.

The laser driver 70, the semiconductor laser 73, the resistor Rpd, and the resistor RLd corresponding to yellow and the laser driver 70, the semiconductor laser 73, the resistor Rpd, and the resistor RLd corresponding to magenta are mounted on the laser circuit board 54 of the present embodiment. The laser driver 70, the semiconductor laser 73, the resistor Rpd, and the resistor RLd corresponding to cyan and the laser driver 70, the semiconductor laser 73, the resistor Rpd, and the resistor RLd corresponding to black are mounted on the laser circuit board 62 of the present embodiment. Since the same correspondence is established between the laser driver of each color and the controller 205*a*, the laser driver of one color is exemplified in FIG. 3 and the laser drivers of the other colors are not illustrated on the same board in FIG. 3.

As illustrated in FIG. 3, the semiconductor laser 73 includes the light emitting unit (laser diode (LD)) 72 and a photodiode (PD) 71. The controller 205*a* supplies a video signal to a bipolar transistor (TR) 74 in order to cause the LD 72 to emit light. The video signal is a signal of two values: High and Low. While the video signal input into the TR 74 has a value of High, the LD 72 emits light because current ILD flows through the LD 72. When the LD 72 emits the light, the PD 71 detects part of the laser light. The PD 71 outputs current Ipd corresponding to the intensity of the light that is detected. Voltage Vpd defined by the current Ipd and the resistor Rpd is supplied to an auto power control (APC) circuit 76. Reference voltage Vref output from the controller 205*a* is supplied to the APC circuit 76, in addition to the voltage Vpd. The reference voltage Vref is based on the density of the density detection toner pattern on the image bearing belt 216, which is read by the sensor 77. The APC circuit 76 compares the voltage Vpd with the reference voltage Vref and supplies the result of the comparison to a voltage setter 78 only if a switch 75 is turned on. The switch 75 switches between turning-on and turning-off on the basis of a sample-hold signal (S/H signal) supplied from the controller 205*a*. In a state where the switch 75 is turned on, the voltage setter 78 adjusts voltage VLD so that the result of the comparison is decreased. The current ILD flowing through the LD 72 is determined on the basis of the relationship between the voltage VLD and the resistor RLd. In other words, the voltage setter 78 adjusts the voltage VLD to adjust the current ILD flowing through the LD 72. As described above, the adjustment of the current ILD performed while the S/H signal is turned on is referred to as auto power control (APC). In contrast, in a state where the S/H signal is turned off, the switch 75 is turned off. In this case, the result of the comparison between the voltage Vpd and the reference voltage Vref is not supplied to the voltage setter 78 and the APC is not performed.

Figure 4:
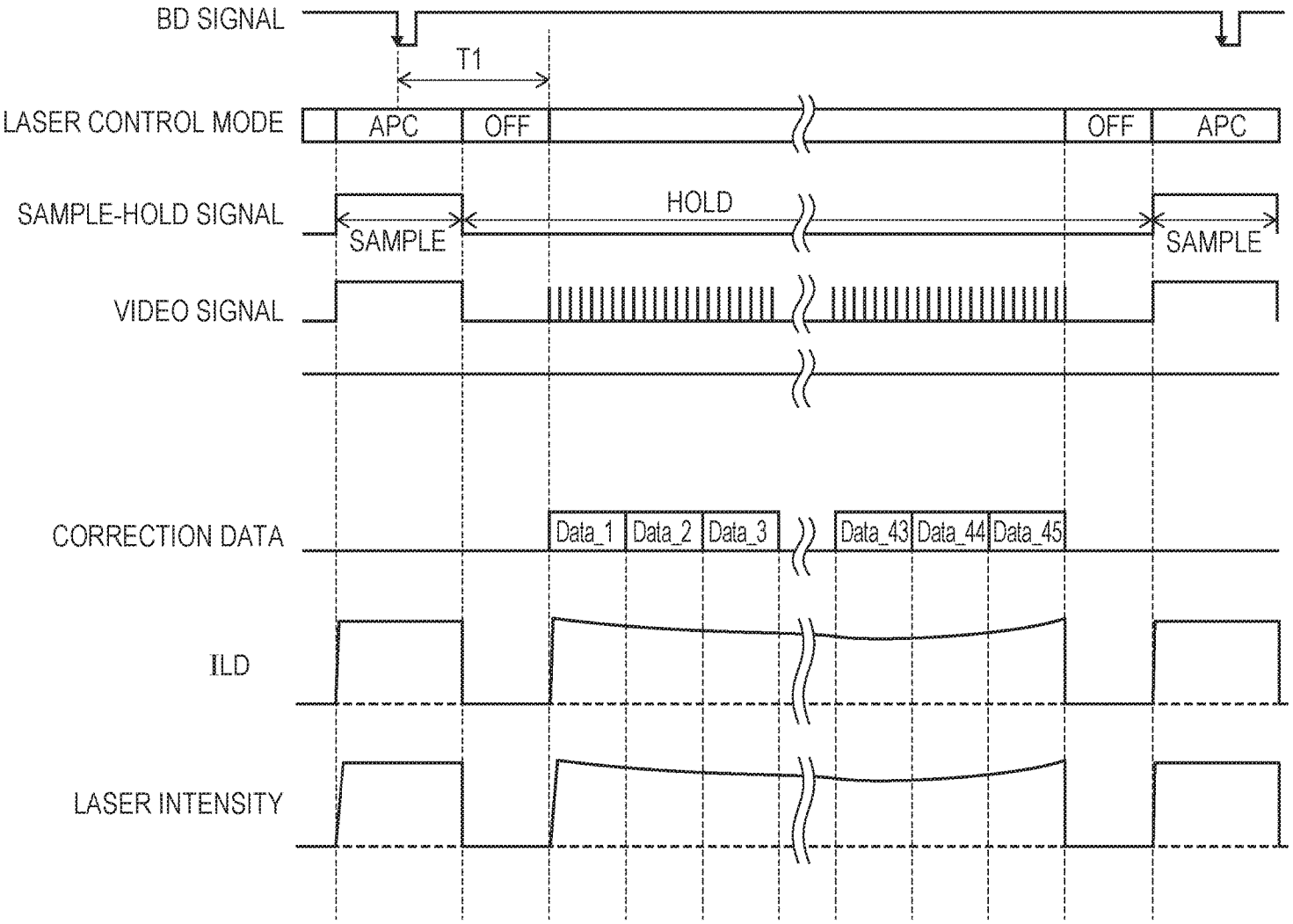
FIG. 4 is a timing chart illustrating light emitting timing of a semiconductor laser and how to control light intensity.

FIG. 4 is a timing chart illustrating light emitting timing of the semiconductor laser and timing of various signals while the photoconductive drum 212 is scanned once with the light beam (one scanning period). Upon detection of the laser light by the BD 55, which is a photo sensor (refer to FIG. 2A), the BD 55 emits the BD signal, which is a pulse signal. As illustrated in FIG. 4, the controller 205*a* turns off the video signal once after the APC is performed and outputs the video signal again after a predetermined time T1 elapsed since the input of the BD signal. Keeping the time T1 constant allows a position where the electrostatic latent image is formed (writing position) on the photoconductive drum 212 during each scanning period to be kept constant.

The writing position is adjusted in accordance with the position of the sheets housed in the paper cassettes in the present embodiment. The reason why the writing position is adjusted in accordance with the position of the sheets housed in the paper cassettes and a method of adjusting the writing position will now be described.

The copying machine supplies a sheet from any of the paper cassettes C1 to C3 to the transfer unit, as described above. The position of the sheet that has reached the transfer unit may be shifted from the image in the main scanning direction. The shifting of the position of the sheet from the image in the main scanning direction causes the position of the image transferred to the sheet to be shifted from a desired position. This shift affects, for example, the size of a margin in the image formed on the sheet.

Factors causing the variation of the position of the sheet in the main scanning direction include variation in positioning of each paper cassette on the frame of the main body of the copying machine and variation in dimensions of parts composing the paper cassette. Accordingly, the amount of shift of the position is varied in each paper cassette. In other words, the position of the image formed on the sheet is varied depending on which paper cassette the sheet is fed from to possibly make a complaint from the user.

In the present embodiment, how much the sheet that has reached the transfer unit is shifted in the main scanning direction is measured in advance for each paper cassette. The time T1 illustrated in FIG. 4 is adjusted on the basis of the result of the measurement of the amount of shift for each paper cassette. Setting the amount of adjustment of the time T1 for each paper cassette enables the position of the sheet in the main scanning direction to be matched with the position of the image in the main scanning direction regardless of which paper cassette the sheet is fed from. The controller 205*a* includes a module that adjusts the time T1 for each paper cassette. The controller 205*a* corresponds to an adjustment unit that adjusts the writing position.

The writing position in the main scanning direction is adjusted depending on which paper cassette the sheet is fed from with the method described above in the present embodiment. However, the adjustment of the writing position for each paper cassette is not performed in a case in which a test image used to correct density unevenness in the main scanning direction is to be printed. The reason for this will be described below.

Although the semiconductor laser is used as the light source for exposing the photoconductive drum to light in the present embodiment, the light source is not limited to the semiconductor laser. For example, the photoconductive drum may be exposed to light using an LED array in which multiple LED chips are arranged in a row in the rotation axis direction of the photoconductive drum. In a case where the LED array is used, the position of the image and the position of the sheet are adjusted depending on which LED chip corresponds to an end portion of the image in the rotation axis direction of the photoconductive drum.

[Method of Correcting Density Unevenness in Main Scanning Direction]

Figure 5:
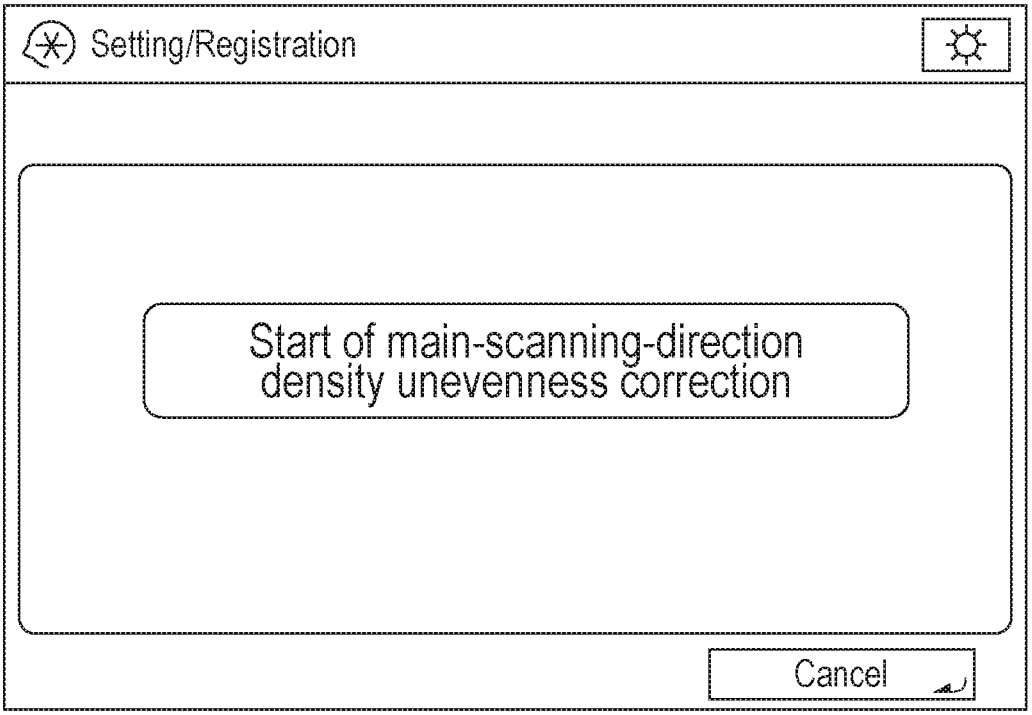
FIG. 5 is a diagram illustrating a start of main-scanning-direction density unevenness correction screen displayed in a display unit.
Figure 6A:
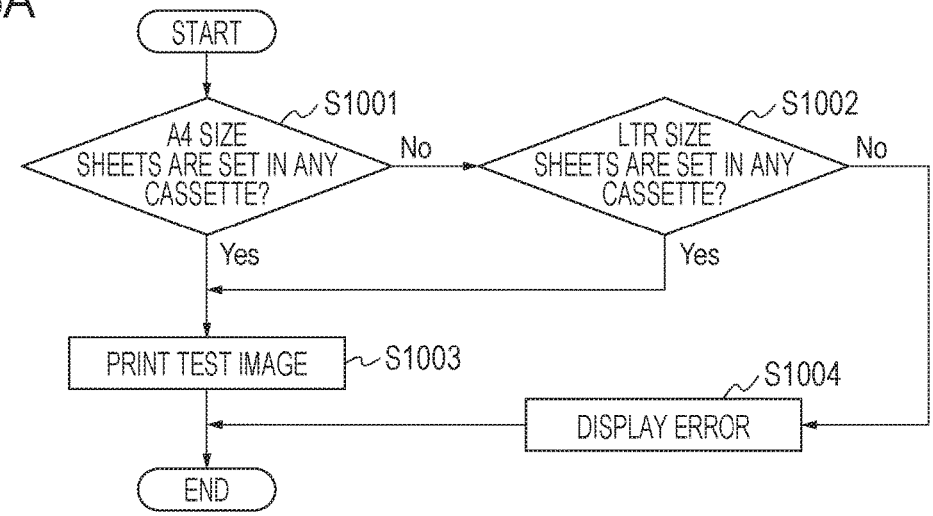
FIGS. 6A and 6B are flowcharts illustrating a process of correcting density unevenness in a rotation axis direction of the photoconductive drum.
Figure 7A:
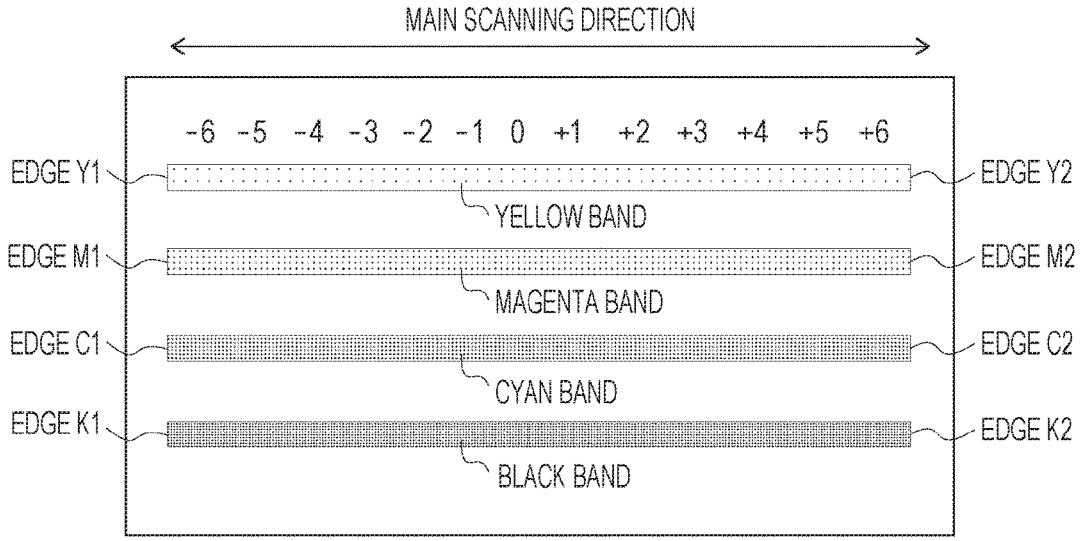
FIGS. 7A and 7B illustrate test images.

A method of correcting the density unevenness in the main scanning direction, which the present embodiment is characterized by, will now be described. Upon operation of the display unit 206 in the copying machine 201 by the user, a start of main-scanning-direction density unevenness correction screen illustrated in FIG. 5 is displayed in the display unit 206. Upon clicking of a start of main-scanning-direction density unevenness correction button by the user, a process illustrated in FIG. 6A is started. FIG. 6A is a flowchart illustrating a process performed by the controller 205*a* in the present embodiment in a case where the test image used to correct the density unevenness in the main scanning direction is to be formed. The method of correcting the density unevenness will now be described with reference to the flowchart in FIG. 6A. In Step S1001 (hereinafter simply denoted by S1001 and so on), the controller 205*a* determines whether the A4 size sheets are set in any of the paper cassettes C1 to C3. If the controller 205*a* determines that the A4 size sheets are set in any of the paper cassettes C1 to C3 (YES in S1001), in S1003, the controller 205*a* prints a test image illustrated in FIG. 7A. As illustrated in FIG. 7A, bands corresponding to the respective colors are printed in the main scanning direction in the test image. Numeric characters from −6 to +6 indicated in the test image represent addresses, which indicate positions in the main scanning direction. All of the bands of the respective colors are formed under the same condition. The condition here means the image density and the laser intensity. If any main-scanning-direction density unevenness occurs, the density unevenness occurs in the bands. As described below, density correction is performed so that the toner image to be formed at each address has uniform density in the present embodiment.

Figure 7B:
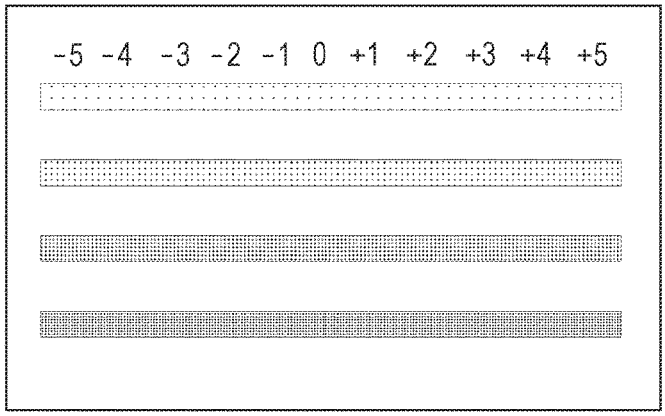

Referring back to the flowchart in FIG. 6A, if the controller 205*a* determines that the A4 size sheets are set in none of the paper cassettes C1 to C3 (NO in S1001), in S1002, the controller 205*a* determines whether the LTR size sheets are set in any of the paper cassettes C1 to C3. If the controller 205*a* determines that the LTR size sheets are set in any of the paper cassettes C1 to C3 (YES in S1002), in S1003, the controller 205*a* prints a test image illustrated in FIG. 7B. The A4 size sheets are preferentially selected to print the test image for the following reason. The width of the A4 size sheets in the main scanning direction is about 297 mm while the width of the LTR size sheets in the main scanning direction is about 279 mm. Accordingly, the dimension of the photoconductive drum 212 in the main scanning direction is designed so as to be capable of forming an image corresponding to the wider A4 size. In a case where the test image is printed on an LTR size sheet, as illustrated in FIG. 7B, the test image is not formed in portions corresponding to the address +6 and the address −6. The density is not capable of being directly corrected on the basis of the image printed on the sheet for the portions where no test image is formed. Since the formation of the test image on a sheet having a large width in the main scanning direction increases the area where the density is capable of being directly corrected, the A4 size sheets are preferentially selected to form the test image in the present embodiment.

If the controller 205*a* determines that the A4 size sheets and the LTR size sheets are set in none of the paper cassettes C1 to C3 (NO in S1002), in S1004, the controller 205*a* displays an error and the process illustrated in FIG. 6A is terminated.

In a case where an image other than the test image is to be printed, the writing position of the laser in the main scanning direction is adjusted for each paper cassette, as described above. For example, the ROM 205*b* holds the amount of adjustment T1 (adjustment time) for adjusting the writing position, illustrated in FIG. 4, for each color and for each of the paper cassettes C1, C2, and C3. Specifically, the ROM 205*b* holds data indicating the amount of adjustment of the writing position, which is calculated as a product (12) of the number of paper cassettes (3) and the number of colors (4). The controller 205*a* reads out from the ROM 205*b* the data indicating the amount of adjustment for each color in accordance with the paper cassette from which a sheet on which an image is to be formed is supplied and controls the output timing of the video signal of each color during each scanning period on the basis of the amount of adjustment with respect to the timing when the BD signal is generated. However, this adjustment is not performed when the test image is to be formed in the present embodiment. This is because, in a case where the test image is to be formed, non-adjustment of the writing position in the main scanning direction allows the main-scanning-direction density unevenness to be corrected with high accuracy. The amount of adjustment T1 (adjustment time) causing the center of the test image formed on the sheet to substantially coincide with the center of the photoconductive drum in the rotation axis direction of the photoconductive drum is held in the ROM 205*b* for each color. In a case where the test image is to be formed, the controller 205*a* reads out the amount of adjustment T1 for each color from the ROM 205*b* regardless of the paper cassette from which a sheet on which an image is to be formed is supplied and controls the output timing of the video signal of each color during each scanning period on the basis of the amount of adjustment with respect to the timing when the BD signal is generated.

The adjustment will now be described in detail. As illustrated in FIG. 7A, the bands of the respective colors are formed in the test image. In addition, edges are provided on both sides of the band of each color. For example, in the case of the band of yellow, an edge Y1 and an edge Y2 are provided. The density unevenness in the main scanning direction is corrected with the middle point between the edge Y1 and the edge Y2 being matched with the center position of the photoconductive drum 212Y in the main scanning direction. The middle positions of the bands of the respective colors are matched with the center positions of the photoconductive drums of the respective colors using the same method also for the bands of magenta, cyan, and black. With this method, it is possible to correct the density unevenness in the main scanning direction without being affected by the position of the sheets of each paper cassette. Adversely, adjusting the writing position in the main scanning direction for each paper cassette shifts the middle point between the edge Y1 and the edge Y2 from the center position of the photoconductive drum in the main scanning direction by the amount of adjustment. In this case, the density is corrected at a position shifted from the position where the correction should be performed and it is not possible to accurately correct the density unevenness. Accordingly, non-adjustment of the writing position in the main scanning direction for each paper cassette in a case where the test image is to be printed allows the position of the test image in the main scanning direction to be matched with the position of the photoconductive drum in the main scanning direction with high accuracy.

Figure 6B:
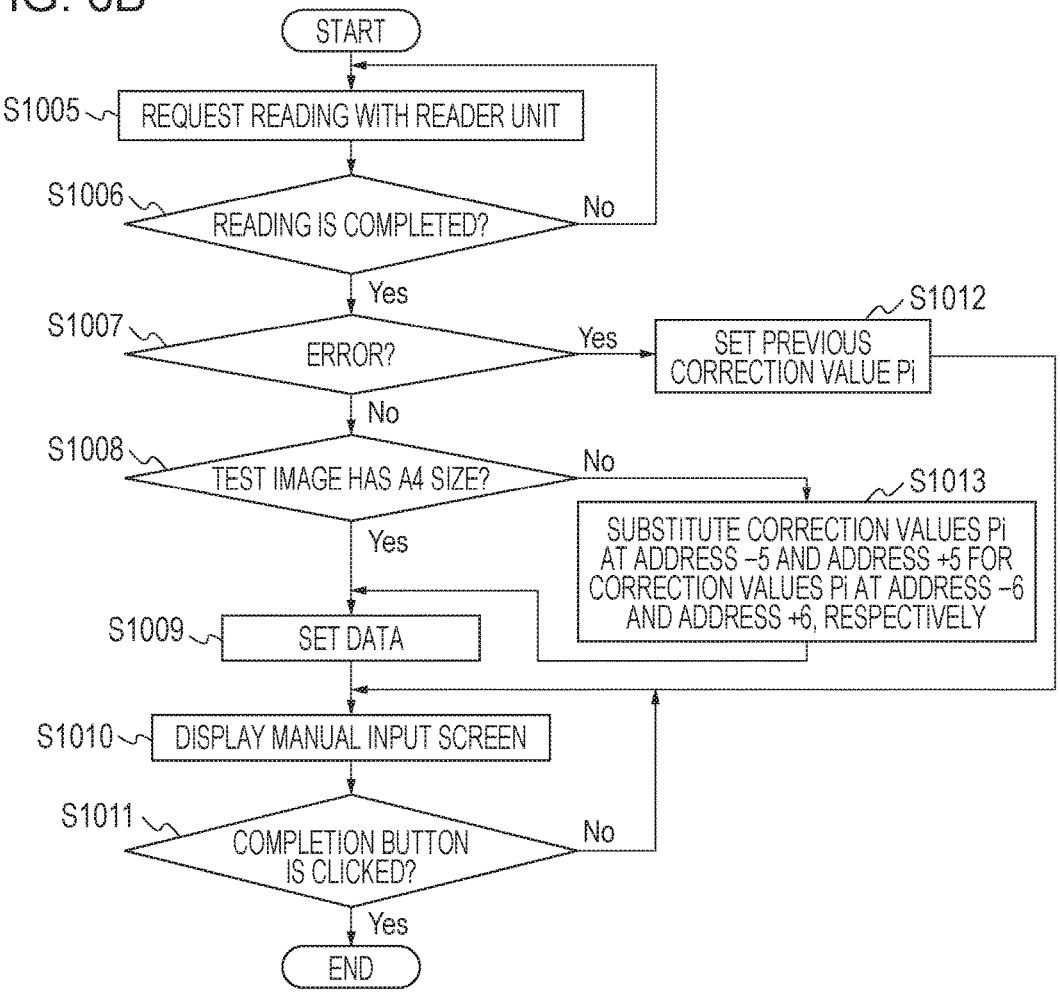
Figures 8A, 8B, 8C:
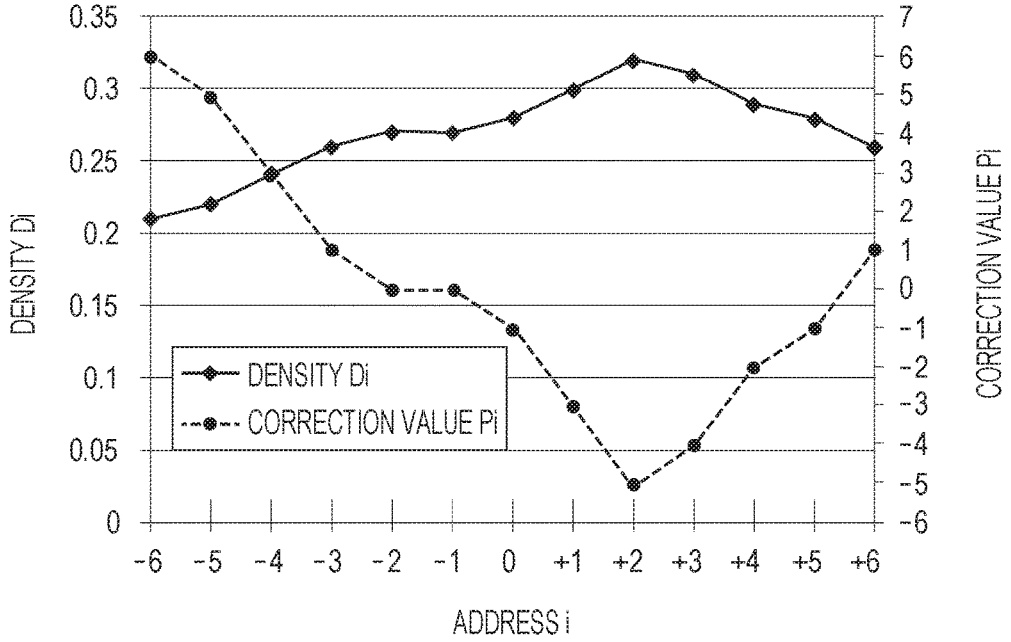
FIGS. 8A to 8C are a graph and tables illustrating the result of detection of the test image and correction values corresponding to the result of detection.

A method of correcting the density unevenness in the main scanning direction using the test image formed on a sheet will now be described with reference to FIG. 6B. Upon printing of the test image on a sheet through the process illustrated in the flowchart in FIG. 6A, in S1005, a screen requesting reading of the test image with the reader unit 202 is displayed in the display unit 206. Information about the density of each color, which corresponds to the position in the main scanning direction, is acquired by reading the test image set in the reader unit 202 by the user in response to the request by the reader unit 202. The acquired information about the density is stored in the RAM 205*c* (refer to FIG. 3) provided in the main body circuit board 205, which functions as a control unit. A solid line in a graph illustrated in FIG. 8A indicates exemplary density data that is acquired. The horizontal axis in FIG. 8A represents positions in the main scanning direction using addresses. These addresses correspond to the addresses indicated in the test image (refer to FIG. 7A). The left-side vertical axis in FIG. 8A represents density D1 of the image at the corresponding address.

In S1006, it is determined whether the reading is completed. If it is determined that the reading is not completed (NO in S1006), the process goes back to Step S1005. If it is determined that the reading is completed (YES in S1006), in S1007, the controller 205*a* in the main body circuit board 205 (refer to FIG. 3) performs error determination to determine whether any abnormal value exists in the density values that are read. The abnormal value indicates, for example, a case in which the density value is extremely varied between adjacent addresses. In such a case, the controller 205*a* supposes that the formation and the reading of the test image are not normally completed. The density correction based on the abnormal value may possibly reduce the image quality. Accordingly, if any error is found (YES in S1007), in S1012, the correction value is determined using the previous result of reading to set the data. After S1012, the process goes to S1010.

If no error is found (NO in S1007), the controller 205*a* functioning as a correction data generating unit determines a correction value Pi through the following arithmetic operation. The correction value Pi is calculated so as to correct the variation in density at each address. Specifically, the controller 205*a* identifies an address having the lowest density value with reference to the density data at each address stored in the RAM 205*c*. The controller 205*a* determines the degrees of correction of the densities at the other addresses so as to be matched with the density at the address having the lowest density. The correction value Pi at each address is calculated according to the following equation:

$$Pi=\{D\text{min}-D(i)\}\times\alpha \quad (1)$$

In Equation (1), Dmin denotes the density value at the address having the lowest density. In the example illustrated in FIG. 8B, the address −6 has the lowest density where Dmin=0.21. D(i) denotes the density at an address i. At the address +3 in the example illustrated in FIG. 8B, D(+3)=0.31. In Equation (1), α denotes a coefficient used to convert the difference in density into the correction value. An example of the correction value Pi calculated in the above manner is illustrated by a broken line in the graph illustrated in FIG. 8A. The intensity of laser light at the corresponding address is increased with the increasing value of the correction value Pi. As apparent from the graph illustrated in FIG. 8A, the intensity of laser light is increased in a portion where the density is low in the main scanning direction in the present embodiment. In contrast, the intensity of laser light is decreased in a portion where the density is high. The uniform density of the toner image is achieved in the main scanning direction by adjusting the intensity of laser light in the above manner.

Figure 9:
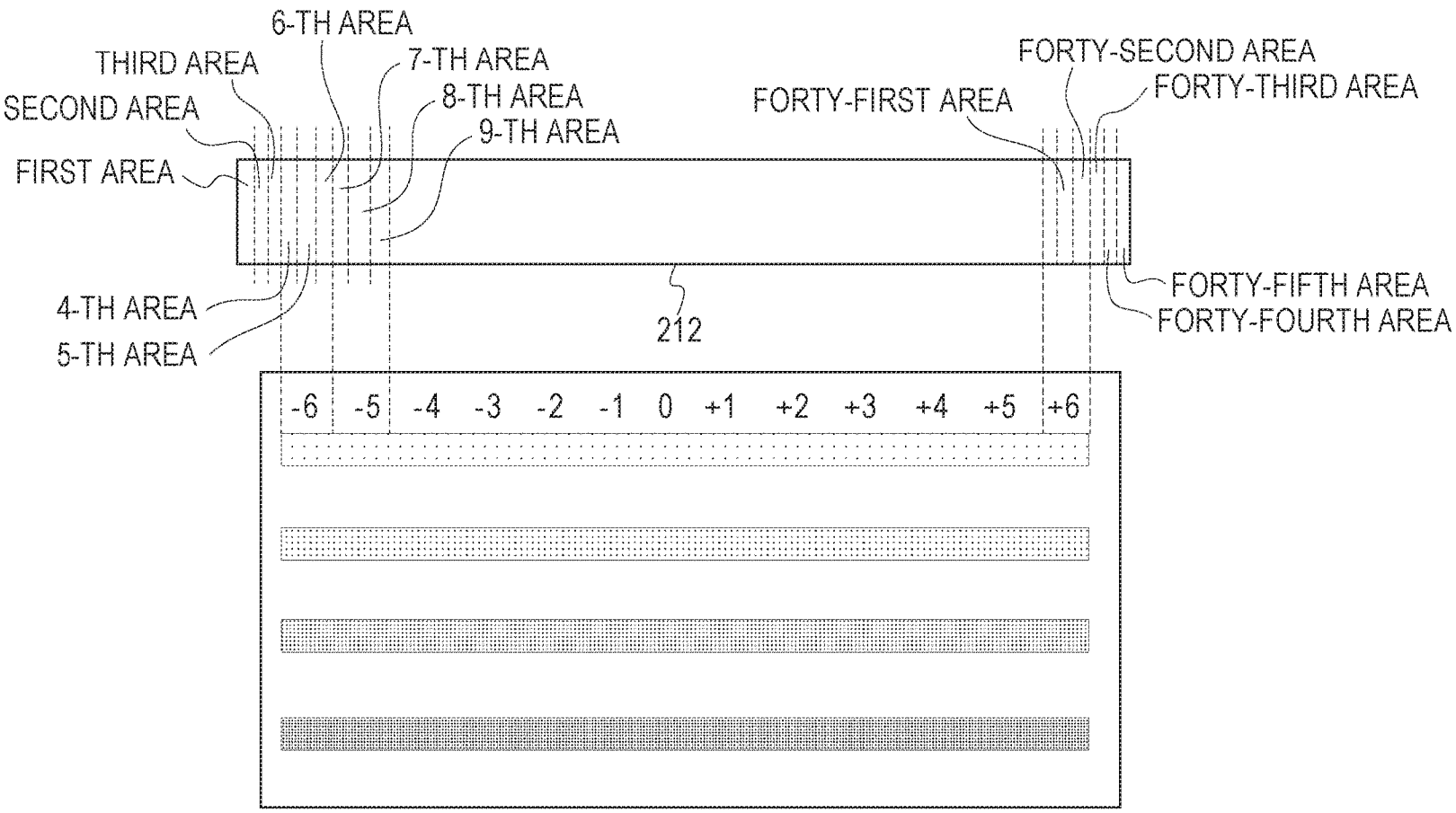
FIG. 9 illustrates exemplary positional relationship between the test image and the photoconductive drum in the rotation axis direction of the photoconductive drum.

How to control the intensity of laser light for achieving the uniform density of the toner image will now be described. In order to control the intensity of light for exposure depending on the position in the main scanning direction, control areas are allocated to each position in the main scanning direction on the photoconductive drum 212. FIG. 9 illustrates an example of the control areas allocated on the photoconductive drum. In the present embodiment, the photoconductive drum 212 is equally segmented into 45 areas from the first area to the forty-fifth area. FIG. 9 also illustrates the correspondence between the addresses of the test image and the control areas on the photoconductive drum. In the present embodiment, the correction value at the address −6 is applied to the fourth area to the sixth area. Similarly, the correction value at the address −5 is applied to the seventh area to the ninth area. The correction value Pi at each address is segmented into the correction values of the corresponding control areas.

Referring back to FIG. 3, a control method to vary the light intensity using the correction value will be described. The correction values at the respective addresses and of the respective control areas are stored in the RAM 205*c*. The controller 205*a* supplies the correction value of each control area to the voltage setter 78. The voltage setter 78 varies the value of the voltage VLD during one scanning period with respect to the voltage defined through the APC described above. The voltage VLD is varied during one scanning period on the basis of the correction value of each control area. When the voltage setter 78 varies the voltage VLD, the current ILD is also varied. When the current ILD is varied, the intensity of light emitted from the LD 72 during one scanning period is varied to correct the density of the toner image. In other words, the voltage setter 78 functioning as a correction unit corrects the density during one scanning period using the correction value. FIG. 4 illustrates how to correct the intensity of laser light during one scanning period using the correction value. Referring to FIG. 4, Data_1 to Data_45 indicate the correction values of the respective control areas.

As illustrated in FIG. 9, the bands of the corresponding toner image exist for the areas from the fourth area to the forty-second area. Correction data directly acquired from the result of reading of the toner image formed in the test image in the above manner is referred to as first correction data.

In contrast, the corresponding toner image does not exist for the areas from the first to third areas and from the forty-third area to the forty-fifth area. This is because the dimension of the photoconductive drum in the main scanning direction is designed so as to be larger than the maximum dimension of the sheet on which the image is to be formed in order to address the variation in the position in the main scanning direction of the sheet that has reached the transfer unit, as described above.

In the present embodiment, the correction value of the adjacent fourth area is used as the correction data for the correction of the light intensity in the areas from the first area to the third area. Similarly, the correction value of the adjacent forty-second area is used as the correction data for the correction of the light intensity in the areas from the forty-third area to the forty-fifth area. As described above, the density correction data corresponding to an area outside the area where the toner image is formed in the test image is referred to as second correction data. The range on the photoconductive drum 212 corresponding to the second correction data in a case where the test image is formed on the A4 size sheet is different from that in a case where the test image is formed on the LTR size sheet. Specifically, the range corresponding to the second correction data in a case where the test image is formed on the LTR size sheet is wider than that in a case where the test image is formed on the A4 size sheet.

Advantages of determining the second correction data on the basis of the first correction data will now be described. The density unevenness in the main scanning direction occurs due to, for example, the variation in the sensitivity of the photoconductive drum to light. Accordingly, the density is often smoothly varied, like waves. The correction of the light intensity using the first correction data in the adjacent control area as the second correction data may produce an effect of reducing the density unevenness, compared with a case in which the light intensity is not corrected.

The amount of variation of the correction value between the respective control areas may be made small in consideration of the fact that the density is smoothly varied, like waves. For example, the correction value at the address −6 is applied only to the fifth area and the correction value at the address −5 is applied only to the eighth area. The correction values may be determined for the other control areas (the first to fourth areas, the sixth to seventh areas, and so on) using approximate expression (such as linear approximation or polynomial approximation) on the basis of the correction value of the fifth area and the correction value of the eighth area.

Although the density unevenness is corrected by varying the intensity of light to which the photoconductive drum is exposed in the present embodiment, the correction of the density unevenness is not limited to this. For example, the density of image data to be printed in the main scanning direction may be adjusted using the first correction data and the second correction data. In a case where the density of the image data is adjusted using the correction data, the controller 205*a* functions as the correction unit.

Referring back to FIG. 6B, in S1008, the controller 205*a* determines whether the test image that is read has the A4 size. If the test image does not have the A4 size (NO in S1008), the test image has the LTR size (refer to S1001 and S1002 in FIG. 6A). In this case, in S1013, the controller 205*a* substitutes the correction value at the address +5 for the correction value at the address +6 and substitutes the correction value at the address −5 for the correction value at the address −6, as illustrated in FIG. 8C. In other words, the controller 205*a* determines the correction values for the address +6 and the address −6, which is the second correction data, on the basis of the correction values at the address +5 and the address −5, which is the first correction data. S1013 is performed in the above manner for the following reason.

In the case of the A4 size sheet, the correction values Pi corresponding to the address +6 to the address −6 are calculated. In contrast, in the case of the LTR size sheet, the correction values Pi corresponding to the address +5 to the address −5 are calculated. In other words, the correction values corresponding to the address +6 and the address −6 are not calculated in the case of the LTR size sheet. This is because, in a case where the test image is formed in the LTR size, the test image is not printed in the portions corresponding to the address +6; and the address −6, as described above. Accordingly, in a case where the correction values are calculated on the basis of the test image of the LTR size, the correction values at the address +6 and the address −6 are blank (that is, the correction is not performed). In this case, the density unevenness between the address +5 and the address +6 may possibly be noticeable. In addition, the density unevenness is often smoothly distributed, like waves, as described above. Accordingly, estimating the correction data outside the area on the basis of the correction data in the range in which the test image is printed for use may produce an effect of making the density unevenness less noticeable.

In addition, the load on the user is capable of being reduced by displaying a manual input screen. In the present embodiment, as illustrated in FIG. 6B, after S1013 or if the controller 205*a* determines that the test image has the A4 size (YES in S1008), in S1009, the data is set. After the data is set, a mode is provided in which the user recognizes the set data to manually update the data. Specifically, in S1010, the controller 205*a* displays the manual input screen. The user who is not satisfied with the result of the automatic density unevenness correction from S1005 to S1009 is capable of manually inputting the correction value in this mode. In the manual input mode, an input screen illustrated in FIG. 10 is displayed in the display unit 206. In the input screen illustrated in FIG. 10, the correction values corresponding to the positions in the main scanning direction of each color are displayed so as to be updated below Y, M, C, and Bk. In other words, the user is capable of manually updating the correction values that are displayed. In a case where S1013 is not performed in the manual input mode, the values set at the address +6 and the address −6 are blank and the user is not sure which value to set. In a case where S1013 is performed, the reference values for the correction values at the address +6 and the address −6 are input, thus reducing the load on the user.

After the manual input screen is displayed, in S1011, it is determined whether the user clicks a Completion button. If it is determined that the user clicks the Completion button (YES in S1011), the correction process illustrated in FIG. 6B is terminated. If it is determined that the user does not click the Completion button (NO in S1011), the process goes back to S1010.

In the present embodiment, since the manual input screen is displayed (S1010) after the correction value is automatically set (S1009), an opportunity to confirm and update the correction values is provided to the user. However, in a case where the user does not want to perform the confirmation and update of the correction values, the correction process illustrated in FIG. 6B may be terminated without displaying the manual input screen and the Completion button after S1009.

Although the A4 size sheet and the LTR size sheet are exemplified as the sizes of the sheet on which the test image is to be formed, the sizes of the sheet on which the test image is to be formed is not limited to these. For example, in a case where the maximum size in the main scanning direction supported by the copying machine is the LTR size (the length in the main scanning direction is 216 mm), an LTTR test image may be preferentially formed to correct the density unevenness. In this case, the A4 size in S1001 and S1008 is replaced with the LTTR size and the LTR size in S1002 is replaced with, for example, A4 R size (the length in the main scanning direction is 210 mm). Also in this case, in S1013, printing is performed on the A4 R size sheet and the correction values Pi at adjacent addresses are substituted for the correction values at the addresses in portions where no test image is formed.

Although the density unevenness is corrected through the density measurement at the thirteen points from the address +6 to the address −6 in the present embodiment, the number of the points for which the density measurement is performed may be varied in accordance with the density unevenness that has occurred and/or the dimension in the main scanning direction.

Although the correction data corresponding to the addresses displayed in the test image is displayed in the display unit in the present embodiment, a mode may be provided in which the correction data in each control area is displayed. Although the control areas are not suitable for an operation by the user because the many control areas are provided, the control areas are useful in a case in which a serviceman fine-tunes the control areas that are displayed. In this case, even when the A4 size sheet is used, the first correction data and the second correction data (the correction values corresponding to the first to third areas and the forty-third to forty-fifth areas) are displayed.

It is possible to improve the accuracy of correction of the density unevenness using the test image by adjusting the position where the electrostatic latent image is formed in the rotation axis direction of the photoconductor in a case where an image other than the test image is to be printed and not adjusting the position where the electrostatic latent image is formed in the rotation axis direction of the photoconductor in a case where the test image is to be printed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-234284, filed Nov. 30, 2015, which is hereby incorporated by reference herein in its entirety.

What is claimed is:

1. An image forming apparatus comprising:

an image forming unit comprising:

a rotating photoconductor;

an exposure unit configured to expose the photoconductor to light to form an electrostatic latent image on the photoconductor;

a developing unit configured to develop the electrostatic latent image formed on the photoconductor with toner;

a transfer unit configured to transfer a toner image developed on the photoconductor by the developing unit on a sheet;

a sheet feeding unit including a plurality of paper cassettes, a reading unit configured to read an image formed on a sheet, wherein the image formed on the sheet includes a test image;

a control unit (1) capable of adjusting a position where the electrostatic latent image is formed in a rotation axis direction of the photoconductor by controlling the exposure unit in order to adjust a position of the toner image in the rotation axis direction of the photoconductor on a sheet that has reached the transfer unit, (ii) configured to generate correction data used to correct densities of images in a plurality of areas on the photoconductor, which correspond to an area where the test image is formed in the rotation axis direction of the photoconductor, based on a result of reading of the test image formed on the sheet including the test image by the reading unit, and (iii) configured to correct a density of the toner image to be developed on the photoconductor in the rotation axis direction of the photoconductor using the correction data, wherein, in a case where the image forming unit forms an image other than the test image on a sheet based on input image data, the control unit adjusts the position to form the electrostatic latent image corresponding to the image other than the test image with respect to the rotation axis direction of the photoconductor according to a paper cassette, included in the plurality of paper cassettes, used for feeding the sheet onto which the image other than the test image is formed, wherein, in a case where the image forming unit forms the test image on a sheet, the control unit does not adjust the position to form the electrostatic latent image corresponding to the test image with respect to the rotation axis direction of the photoconductor according to a paper cassette used for feeding the sheet onto which the test image is formed.

2. The image forming apparatus according to claim 1, wherein the control unit corrects an intensity of light to which the photoconductor is exposed by the exposure unit using the correction data in the rotation axis direction of the photoconductor, and performs the correction with a middle point between a first edge and a second edge being matched with a center position of the photoconductor in the rotation axis direction of the photoconductor, the first edge being one end of the test image in the rotation axis direction of the photoconductor and the second edge being the other end thereof.

3. The image forming apparatus according to claim 2, wherein the exposure unit includes a semiconductor laser that emits a light beam, a deflector that deflects the light beam so that the light beam emitted from the semiconductor laser scans the photoconductor, and a photo sensor that detects the light beam deflected by the deflector to emit a pulse signal, wherein the control unit adjusts the position of the electrostatic latent image to be formed on the photoconductor in the rotation axis direction of the photoconductor by adjusting a time from a time when the pulse signal emitted from the photo sensor is received to a time when the semiconductor laser emits the light beam for forming the electrostatic latent image on the photoconductor, and wherein the control unit corrects the density of the toner image to be developed on the photoconductor in the rotation axis direction of the photoconductor by correcting light intensity of the light beam emitted from the semiconductor laser using the correction data.

4. The image forming apparatus according to claim 2, wherein the exposure unit includes a plurality of light emitting diode chips arranged in a row in the rotation axis direction of the photoconductor for exposing the photoconductor to light, wherein the control unit adjusts the position where the electrostatic latent image is formed in the rotation axis direction of the photoconductor by selecting a light emitting diode chip corresponding to an end portion of an image in the rotation axis direction of the photoconductor from the plurality of light emitting diode chips, and wherein the control unit corrects the density of the toner image to be developed on the photoconductor in the rotation axis direction of the photoconductor by correcting intensity of light emitted from each of the plurality of light emitting diode chip using the correction data.

5. The image forming apparatus according to claim 1, wherein the control unit corrects data about a density included in image data using the correction data in the rotation axis direction of the photoconductor, and performs the correction of the density included in the image data with a middle point between a first edge and a second edge being matched with a center position of the photoconductor in the rotation axis direction of the photoconductor, the first edge being one end of the test image in the rotation axis direction of the photoconductor and the second edge being the other end thereof.

6. The image forming apparatus according to claim 1, wherein the exposure unit includes a semiconductor laser that emits a light beam, a deflector that deflects the light beam so that the light beam emitted from the semiconductor laser scans the photoconductor, and a photo sensor that detects the light beam deflected by the deflector to emit a pulse signal, and wherein the control unit adjusts the position of the electrostatic latent image to be formed on the photoconductor in the rotation axis direction of the photoconductor by adjusting a time from a time when the pulse signal emitted from the photo sensor is received to a time when the semiconductor laser emits the light beam for forming the electrostatic latent image on the photoconductor.

7. The image forming apparatus according to claim 1, wherein the exposure unit includes a plurality of light emitting diode chips arranged in a row in the rotation axis direction of the photoconductor for exposing the photoconductor to light, and wherein the control unit adjusts the position where the electrostatic latent image is formed in the rotation axis direction of the photoconductor by selecting a light emitting diode chip corresponding to an end portion of an image in the rotation axis direction of the photoconductor from the plurality of light emitting diode chips.

* * * * *